United States Patent [19]

Gobush et al.

[11] Patent Number: 4,858,923

[45] Date of Patent: Aug. 22, 1989

[54] LOW TRAJECTORY LONG DISTANCE GOLF BALL

[75] Inventors: William Gobush, North Dartmouth, Mass.; Raymond A. Berard, Portsmouth, R.I.; Robert A. Brown, Mattapoisett; John W. Jepson, Marion, both of Mass.

[73] Assignee: Acushnet Company, New Bedford, Mass.

[21] Appl. No.: 207,017

[22] Filed: Jun. 14, 1988

Related U.S. Application Data

[63] Continuation of Ser. No. 18,840, Feb. 24, 1987, abandoned, which is a continuation of Ser. No. 544,780, Oct. 24, 1983, abandoned.

[51] Int. Cl.[4] ..... A63B 37/12; A63B 37/02

[52] U.S. Cl. ..... 273/62; 273/232; 273/227; 273/235 R; 273/220

[58] Field of Search ..... 273/62, 232, 235 R, 273/235 A, 235 B, 214–231

[56] References Cited

U.S. PATENT DOCUMENTS

| | | | |
|---|---|---|---|
| 878,254 | 2/1908 | Taylor | 273/232 |
| 1,369,868 | 3/1921 | Worthington | 273/227 |
| 1,524,428 | 1/1925 | Geer | 273/227 |
| 3,313,545 | 4/1967 | Bartsch | 273/235 |
| 3,784,209 | 1/1974 | Berman et al. | 273/218 |
| 3,819,190 | 6/1974 | Nepela et al. | 273/232 |
| 4,063,259 | 12/1977 | Lynch et al. | 273/232 |
| 4,090,716 | 5/1978 | Martin et al. | 273/232 |
| 4,142,727 | 3/1979 | Shaw et al. | 273/232 |
| 4,337,947 | 7/1982 | Saito et al. | 273/235 R |
| 4,431,193 | 2/1984 | Nesbitt | 273/235 R |
| 4,570,937 | 2/1986 | Yamada | 273/220 |

FOREIGN PATENT DOCUMENTS

| | | | |
|---|---|---|---|
| 377354 | 7/1932 | United Kingdom | 273/232 |
| 1177226 | 1/1970 | United Kingdom | 273/218 |
| 1364138 | 8/1974 | United Kingdom | 273/218 |
| 1381897 | 1/1975 | United Kingdom | 273/232 |
| 1402272 | 8/1975 | United Kingdom | 273/235 R |

*Primary Examiner*—George J. Marlo
*Attorney, Agent, or Firm*—Lucas & Just

[57] ABSTRACT

A golf ball with improved distance is disclosed. The golf ball has a relatively low spin velocity coupled with a particular dimple number, diameter, depth and arrangement. The ball is characterized by a lower flight trajectory and longer total distance.

12 Claims, 5 Drawing Sheets

LOW TRAJECTORY LONG DISTANCE GOLF BALL

This is a continuation of application Ser. No. 018,840 filed Feb. 24, 1987, now abandoned, which in turn is a continuation of application Ser. No. 544,780 filed Oct. 24, 1983, now abandoned.

present invention relates to golf balls and is particularly concerned with the production of golf balls which will travel further than golf balls now on the market without violating any of the rules promulgated by the United States Golf Association (USGA).

For many years golf ball technology remained essentially stagnant other than minor improvements in manufacture of the balls. Virtually all golf balls were of the so-called wound type. This type of golf ball has a small center of about 1 inch to 1-1/16 inch which is typically either a lively rubber ball or a liquid-filled hollow sphere. Windings of elastic thread go around this center to form a core which has a diameter of 1.45 to 1.61 inches. Shell covers, normally composed of balata, are compression molded about the core to form a final ball of 1.68 inches in diameter.

Since about the mid 1960's, there have been a number of improvements in golf balls which the industry considers significant. The first major improvement was the introduction of a new cover material, a Surlyn ionomer resin. This is the first synthetic material to find wide acceptance in the golf industry. While Surlyn resins have taken over much of the market, there is still substantial use of balata, especially among the better players.

A second major improvement was the development of the so-called two-piece golf ball. This is a golf ball in which there is a unitary spherical core of a polymer which is about the same size as the wound core, i.e. 1.45 to 1.61 inches. About this core is a cover of a different polymer, the cover usually being a Surlyn ionomer resin. The cores are normally compression molded and the covers are either injection molded or compression molded thereabout.

A third major accomplishment was in the improvement of the aerodynamic configuration of the golf ball so that the ball will travel further. Since the dawn of golf, attempts have constantly been made to improve the distance a golf ball will travel, and this has been greatly emphasized over the last decade. The improvement in aerodynamic configuration is by far the most significant contribution made to date in increasing golf ball travel without violating USGA rules.

The USGA promulgates rules for the game of golf and these rules include specifications for the golf ball. Compliance with USGA rules is not obligatory and indeed some companies actually allege that they sell "hot" balls that violate USGA rules. Any major manufacturer of golf balls could easily make a "hot" ball which violates the USGA rules; however, all respectable manufacturers adhere to the USGA rules religiously since violation of a rule can result in the ball being banned from all USGA play. This ban includes not only the professional tour, but also most club play and also carries with it a stigma which approaches criminality. Even duffers playing a two dollar Nassau on a public golf course will protest vociferously if others in their foursome try to play an "illegal" ball.

The USGA has two static tests, namely weight and size. The weight of a golf ball must be not greater than 1.620 ounces and the size of the golf ball must be not less than 1.680 inches in diameter. These tests have been in use USGA for many years and most golf ball manufacturers closely approach the acceptable limits. There are also three performance tests for golf balls imposed by the USGA, one being velocity, another being total overall distance, and the third relating to golf ball symmetry.

The velocity requirement, commonly referred to as the maximum initial velocity, specifies that the golf ball may not exceed a velocity of 250 feet per second when measured on apparatus approved by the USGA. There is a 2% tolerance on the velocity, i.e. the highest permissible velocity is 255 feet per second. This rule has been in effect for many years and most top grade manufacturers of wound golf balls have been right up against the highest permissible initial velocity for a great number of years. This is relatively easy to accomplish by either making the windings tighter to get a ball with a higher compression or by making the windings of a "faster" thread, an expedient well-known in the golf ball art. It is pointed out that most manufacturers do not try to actually achieve the 255 feet per second maximum permissible velocity since this entails too much chance of having the ball exceed the limit and be declared in violation of the USGA rules. Most manufacturers have a safety factor and make their average maximum velocity at some lesser value such as in the 250–253 range to minimize the risk of being declared "illegal".

The total overall distance is measured by a test known as the Overall Distance Standard and is 280 yards plus a tolerance of (for a total permissible distance of 296.8 yards). tolerance was formerly 8% but was recently reduced to the 6% level. It has been that the tolerance will be reduced to 4% (for a total permissible distance of 291.2 yards) as test techniques are improved but this has not yet been accomplished nor is it considered likely that this will happen in the foreseeable future. The Overall Distance Standard is a measurement of carry and roll. Carry is the distance from the tee to the point where the golf ball first impacts with the ground and carry and roll is the total distance from the tee to the point where the ball finally comes to rest. The Overall Distance Standard is tested on apparatus approved by the USGA on the outdoor range at the USGA Headquarters. This apparatus is intended to simulate a club known as a driver. Whether the tolerance is 6% or 4%, to the best of the knowledge of the applicants no one has been able to even come close to approaching the total permissible distance of the Overall Distance Standard while still having an initial velocity which does not violate the USGA highest permissible velocity.

While the Overall Distance Standard is the norm used by the USGA, the industry distance standard is frequently taken as the overall distance (carry and roll) of a ball hit with a driver and with a #5 iron. It is still necessary that such a golf ball comply with the USGA standard; however, since the USGA apparatus simulates a hit with a driver, two balls that have essentially the same overall distance on the USGA machine can have substantially different values in the driver plus #5 iron test.

The recently enacted rule elating to golf ball symmetry simply states that the golf ball shall be designed and manufactured to perform in general as if it were spherically symmetrical. The testing to determine symmetry is in the formative stage. At the present time the USGA measures differences in values when balls are struck on two different axes. The differences in values currently measured are peak angle of trajectory, carry distance and time in flight. It is generally accepted that a golf ball with a uniform dimple pattern will meet the USGA test but that a golf ball with a non-uniform pattern (see for example U.S. Pat. No. 3,819,190) will not.

In addition to the distance a ball will travel, another important consideration in a golf ball is the height of its trajectory. Unless headwinds are encountered, the commercially available balls which have the greatest carry distance with a driver tend to be those that have a relatively high trajectory. This high trajectory is attained because of a relatively high spin velocity and aerodynamic configuration which results in relatively high lift and drag coefficients. The difficulty with a high trajectory is twofold. In the first place, a high trajectory ball tends to get up in the area where crosswinds are of greater velocity and make the ball deviate from its intended path. Furthermore, the factors which made the ball go higher also tend to exaggerate undesirable conditions such as upshooting, hooking and slicing.

The applicants have now discovered a construction for a golf ball which is characterized by a relatively lower and flatter trajectory while simultaneously having relatively lower drag. With the lower drag the golf ball will travel at a greater velocity while still having an initial velocity which is within the USGA limit. The overall effect of the lower and flatter trajectory and the lower drag is that the ball will have a carry distance greater than that of high trajectory golf balls. In addition, because the ball is hitting the ground at a shallower angle because of its lower and flatter trajectory and because it impacts at a higher velocity due to its lower drag, it will bounce and roll further than a high trajectory golf ball, thus giving an even greater improvement in overall distance than that obtained in carry distance.

The foregoing highly advantageous result is achieved by using a golf ball having a combination of a particular aerodynamic configuration coupled with a particular spin velocity.

With respect first to the aerodynamic configuration of the golf ball, this relates to the number of dimples, the dimple spacing, the dimple depth and the dimple diameter. In accordance with the present invention, the golf ball has approximately 384 dimples. A tolerance of up to about 3% in the number of dimples is permissible but it is preferred that the number of dimples be between about 376 and 392.

The dimples are substantially evenly spaced over the surface of the golf ball. This can suitably be accomplished by laying out an icosahedron pattern on the surface of the golf ball and making substantially equilateral spherical triangles sufficient to yield 392 vertices, each vertex being the point for the center of a dimple. Laying out of dimple centers on golf balls in this manner is disclosed, for example, in British Patent No. 1,381,897. If this icosahedron/spherical triangle procedure is used to form 392 vertices, there will be 392 points at which dimples can be placed and these will be substantially equally spaced over the surface of the golf ball. It is generally considered desirable in top grade golf balls to remove 4 dimples at each pole, three for application of a trademark and the other for application of an identifying number. This gives the most preferred number of dimples of 384. In addition to removal of dimples for the trademark if desired, other minor changes can be made in the layout of the dimples, e.g. separation of the dimples at the parting line of the golf ball mold to facilitate buffing of the parting line.

The dimples are essentially a section of a sphere and have an interrelated dimple number, dimple diameter and dimple depth expressed by the formula:

$$[554.3(d-x)-37(D-y)]^2+[138.6(D-y)+926(d-x)]^2=S$$

wherein:

d = average dimple depth

D = average dimple diameter x = 0.275–0.0041667N y = 0.2790–0.0333N

N = the exact number of dimples divided by 100

$S \geqq \leqq 1$.

The method of measuring dimple diameter and dimple depth are as set forth in the aforementioned British patent 1,381,897 and particularly that set forth with respect to FIGS. 3–5 and 14–18 thereof. The teachings of British patent 1,381,897 are incorporated herein by reference. It is preferred that at least 95% of the dimples have the specified diameters and depths for a particular dimple number and it is most preferred that all of them do. However, minor modifications for aesthetic or other purposes which do not specifically affect the overall flight of the golf ball are also within the contemplation of the invention.

The preferred dimensions for the dimples for use in golf balls of the present invention are an average diameter of from about 0.145 to about 0.155 inches and an average depth about 0.0103 inches to about 0.0123 inches.

Figure 7:
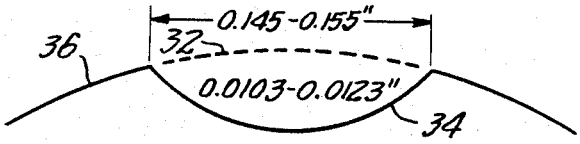
Figure 8:
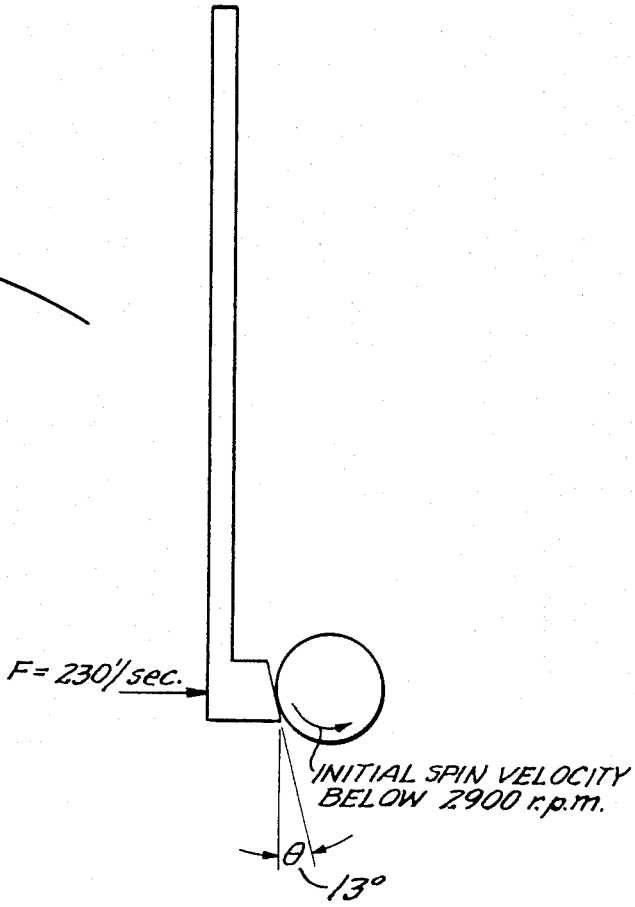
Figure 4:
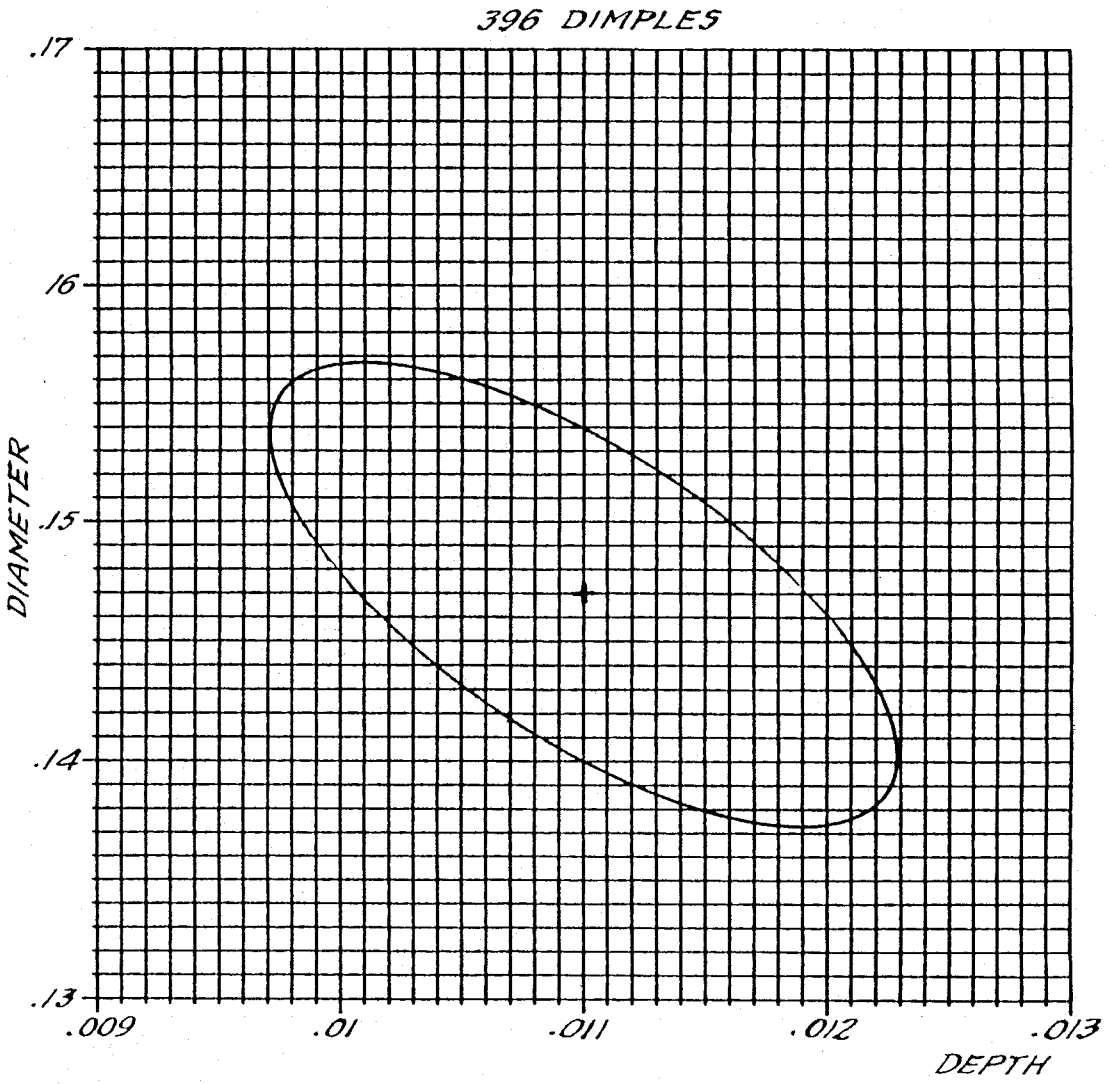
Figure 5:
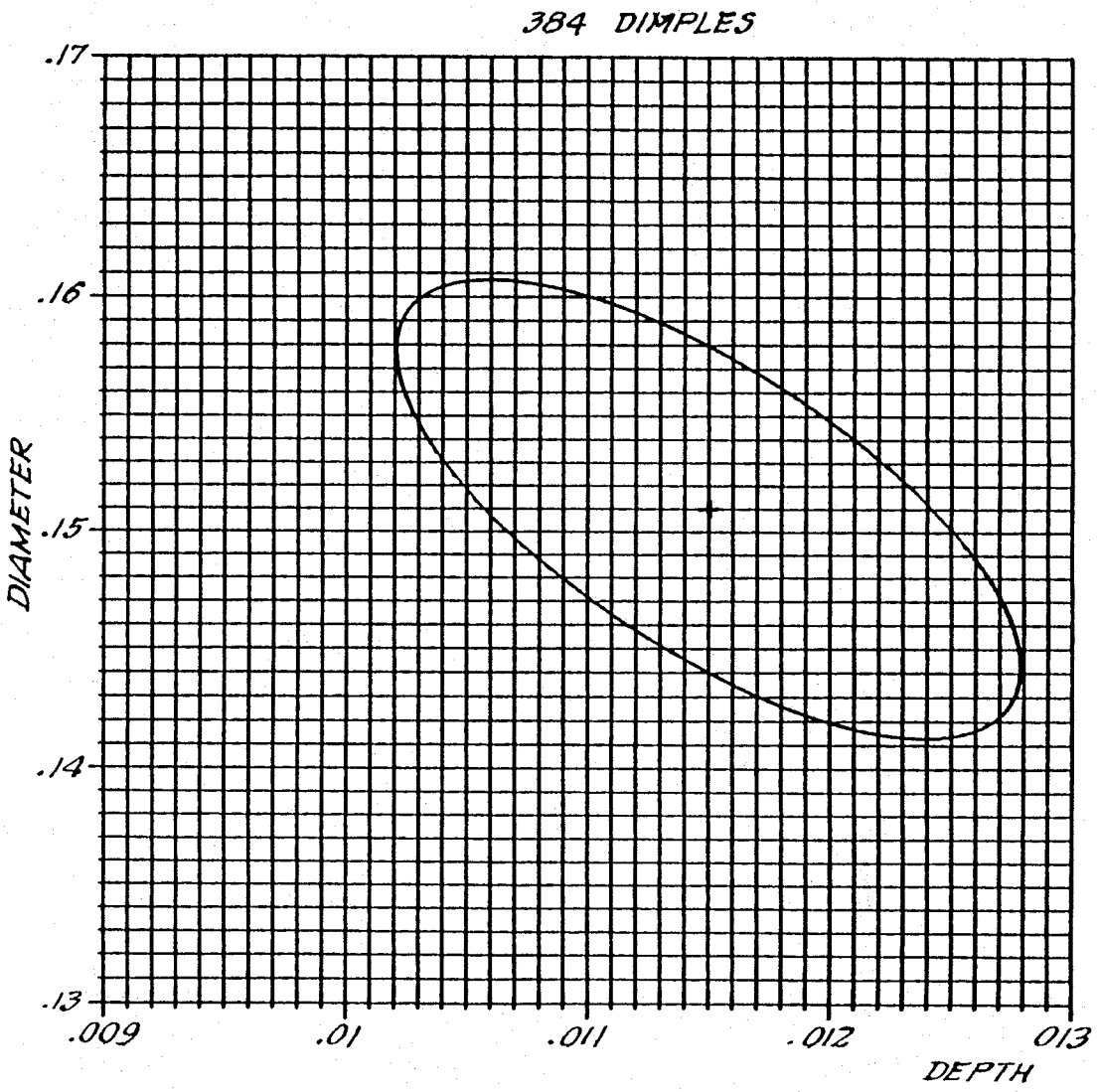
Figure 6:
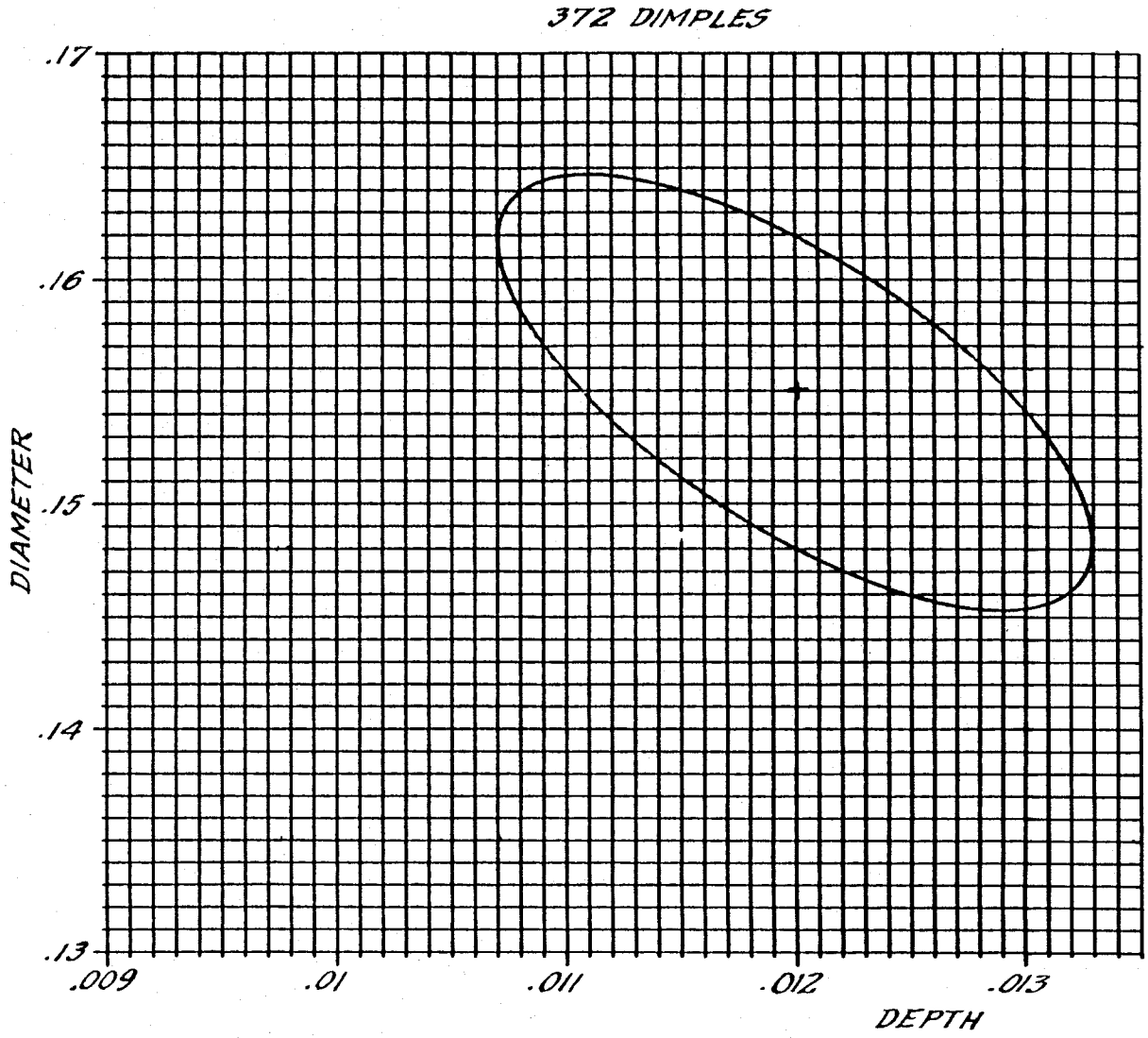

FIGS. 4, 5, and 6 are plots of dimple diameter vs. dimple depth for 396, 384, and 372 dimples, respectively;

FIG. 7 is a cross-section of a typical dimple according to the present invention;

FIG. 8 illustrates spin velocity.

The dimples are laid out in icosahedron/spherical triangle pattern as discussed hereinbefore. In accordance with the present invention dimples 10 at the pole of the ball can be absent to make a smooth surface for a trademark. Dimple 12 can similarly be absent for an identifying number. Dimples 10, 12 and 14 can be absent as discussed in Example 8. Dimples 10, 12 and 14 can be present as discussed in Example 9. Dimples 18 can have a diameter which is different from the rest of the dimples as discussed in Example 10.

Figure 1:
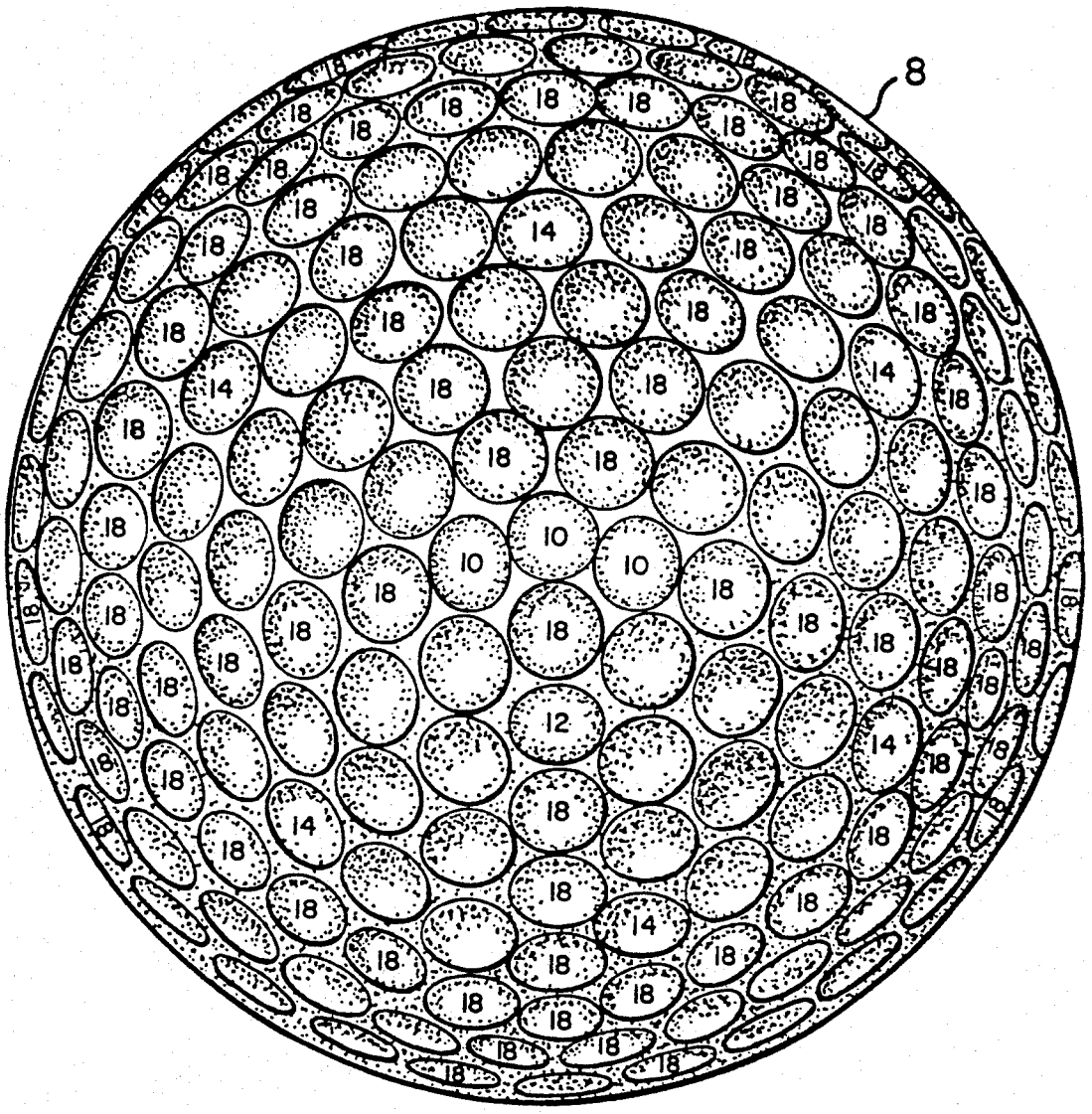
FIG. 1 shows a hemisphere of a golf ball according to the present invention.
Figure 2:
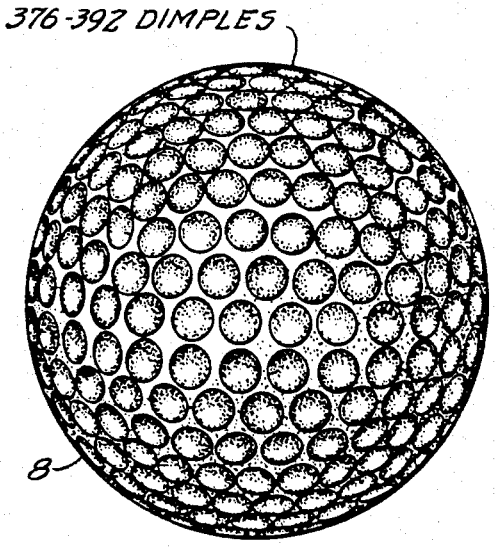
FIG. 2 is the golf ball of FIG. 1 rotated 90° on a horizontal axis.

FIG. 2 shows the golf ball of FIG. 1 rotated 90°. As can be seen in both FIGS. 1 and 2, there are no dimples at the equator 8 of the golf ball.

FIGS. 4, 5, and 6 are plots of dimple depth vs. dimple diameter for 396, 384, and 372 dimples, respectively. The plots were made by substituting the dimple number into the formula set forth hereinabove. As is evident from the plots, the formula yields an ellipse. This is true no matter what the number of dimples.

FIG. 7 shows a cross-section of an individual dimple 34 in a golf ball 36. Golf ball 36 has a radius of curvature which extends along broken line 32. As illustrated, the depth of the ball is from the deepest part of the dimple to the continuation 32 of the periphery of the ball. FIG. 7 also illustrates the preferred diameter of the dimple.

The second essential requirement is the spin velocity of golf ball. Spin velocity varies as a function of the compression of the golf ball. The term "compression" as used herein is well-known in the golf ball industry. Compression is sometimes referred to as PGA compression and is expressed in terms of arbitrary units on a scale known as the PGA compression scale. A nominal compression of 90–100 is used for virtually all top grade golf balls and many manufacturers sell both 90 compression and 100 compression models. In accordance with the present invention the spin velocity of a golf ball having a nominal compression of between 90 and 100 is below about 2900 rpm when hit at 230 feet per second by an implement having a club face angle of 13° with respect to the vertical which results in a launch angle of about 11°. Spin velocity is illustrated in FIG. 8. An implement 28 has a face 30 which is at an angle $\theta$ 13° with respect to the vertical. When implement 28 impacts ball 26 at 230 feet per second, the initial spin velocity of the ball 26 is below 2900 rpm. As a practical matter the lowest spin velocity a ball can attain under these conditions is about 2000 rpm. Machines for establishing the hitting parameters are commonly available in the industry such as from True Temper Corp. Apparatus suitable for making the spin velocity measurement is disclosed in U.S. Pat. No. 4,063,259. This patent also discusses the interrelationship of launch angle and spin velocity.

Figure 3:
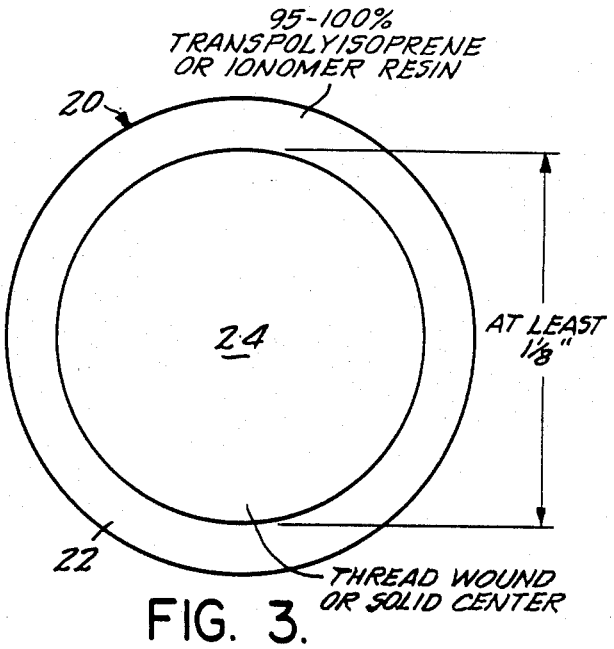
FIG. 3 is a cut-away view of a golf ball.

The spin velocity of the golf balls of the present invention is substantially lower than the spin velocity of conventional wound balata covered golf balls. Such golf balls at a nominal compression of 90–100 typically have a spin velocity of about 3000 to about 3500 rpm when hit at 230 feet per second by an implement having a club face angle of 13°. It has been found, however, that such balata covered balls can be made to spin at the spin velocity desired in the present invention by increasing the size of the liquid center and increasing the hardness of the cover. The center of a wound golf ball normally has a diameter of 1 inch to 1-1/16. In accordance with the present invention, and as shown in FIG. 3, the center 24 of the golf ball is preferably increased to a diameter of $1\frac{1}{8}$ inch±0.003 inch. It has been found that this increase in center diameter from that conventionally used helps to reduce the spin velocity of the golf ball.

The cover of the golf ball is commonly referred to as balata. Balata occurs in nature and can also be obtained synthetically. In either case it is essentially 100% transpolyisoprene. It is a relatively hard material, but is also very expensive and currently costs approximately $5.50 (synthetic) to $12.00 (natural) per pound. In contrast to this, natural rubber, which is 100% cis-polyisoprene, costs about $0.50 per pound. Natural rubber is a softer material which is blended with the balata in amounts up to or even more to bring down the overall cost of the cover material. Other materials are also blended with balata to bring down the cost of the cover, either together with the rubber or instead of it. Notable among these are gutta percha, butadiene, and synthetic rubbers. As illustrated in FIG. 3, to achieve the spin velocity of the present invention, we prefer cover 22 of golf ball 20 to be at least 90% transpolyisoprene and more preferably at least 95% transpolyisoprene and most preferably at least 99% transpolyisoprene. While the combination of the large liquid center and the harder balata cover has been found to be an excellent way to achieve the spin velocity of the present invention in a balata covered wound ball, other ways may also be possible for achieving the desired spin velocity.

Wound core golf balls made with the aerodynamic configuration and spin rate of the present invention have been found to have a lower and flatter trajectory than commercially available wound core golf balls of similar compression while simultaneously having a greater carry distance and a greater total distance, both with the driver and the driver plus #5 iron. With respect to the trajectory, ½ yard in height is considered significant when hitting at a 13° angle at 230 feet per second. Balls according to the present invention have a trajectory which is at least 1 to ½ yards lower than commercially available wound balata covered golf balls. With respect to total carry distance (driver plus #5 iron test), golf balls according to the present invention ha minimum improvement in carry distance as opposed to commercially available golf balls, whether wound or two-piece, balata covered or Surlyn covered, of at least five yards.

These and other aspects of the present invention may be more fully understood with respect to the following examples.

EXAMPLE 1

A group of golf balls w obtained. The golf balls are made by the assignee of the instant invention and are sold under the trademark Titleist Pro Trajectory. These golf balls have a so-called liquid center which is well-known in the golf ball industry. The liquid center was formed from a hollow sphere which had an exterior diameter of 1-1/16-inch. The hollow sphere is completely filled with a liquid. The center is covered with elastic thread of dimension 0.22"×1/16" to a wound ball size of 1.610 inches in diameter. On top of that is molded a cover comprising the following ingredients:

| | |
|---|---|
| Resin | 76.2% |
| Resin composed of: | |
| Transpolyisoprene | 84% |
| Natural Rubber | 16% |
| Filler | 22.5% |
| Other | 1.3% |

The molded golf balls are treated and painted in standard manner. The diameter of the finished golf balls is 1.680 inches. It is pointed out that all diameters given are average values. Actual values may vary as much as 0.003 inches.

The golf balls have 324 dimples distributed uniformly over the surface of the golf ball with centers at the vertices of an icosahedron/spherical triangle arrangement as described in British Patent No. 1,381,897 except that four vertices at each pole do not dimples in order to provide a smooth surface for the trademark and identifying number and the vertices have been slightly rearranged at the equator to separate the dimples-for the mold parting line. The dimples have a diameter of 0.146 inch±0.002 inch and a depth of 0.0122 inch±0.0003 inch.

EXAMPLE 2

A group of golf balls was made in accordance with the present invention. The golf balls had the same type of liquid filled center as the golf balls of Example 1 and were made using the same elastic thread as used in Example 1 and the wound ball diameter was the same 1.610 inch.

In this case, however, the golf balls were made to conform to the parameters of the present invention. The size of the center was increased to 1-⅛ inch. The cover composition molded onto the wound ball was changed to be 100% transpolyisoprene polymer as follows:

| | |
|---|---|
| Resin | 76.7% |
| Resin composed of: | |
| Transpolyisoprene | 100% |
| Natural Rubber | 0% |
| Filler | 22.0% |
| Other | 1.3% |

The composition of the Filler and Other were the same as in Example 1 except that slightly less Filler was utilized. The molded balls were treated and painted in standard manner. The diameter of the finished balls was 1.680 inches. As with Example 1, diameter tolerance was up to 0.003 inch.

Further in accordance with the present invention, the golf balls had 384 dimples substantially evenly spaced over the surface of the golf ball utilizing an icosahedron/spherical triangle pattern as described for the golf balls of Example 1. As with the golf balls of Example 1, four vertices were not used for dimples in the area of each pole to provide a smooth surface of a trademarks and identifying number and dimple vertices were slightly rearranged at the equator for the mold parting line. The dimples had a diameter of 0.146 inch±0.002 inch and a depth of 0.0115 inch±0.0003 inch.

COMPARATIVE TESTS

The finished golf balls of Examples 1 and 2 were compared for a number of properties. Balls were selected from each Example which were statistically comparable for USGA standards, i.e. size, weight and initial velocity. Each selected had a weight of 1.610–1.620 ounces, a size of 1.680–1.690 inches, and an initial velocity of 253.0–253.5 feet per second. The variations in size, weight and velocity have been found to be statistically insignificant for the number of balls tested. The balls were first analyzed for spin rate. This was done for both a driver and a #5 iron. A ball hit with a driver typically has a launch angle of 11° and a bal hit with a #5 iron typically has a launch angle of 21°. The spin rates were determined by machine tests at the indicated angles using an apparatus of the type disclosed in U.S. Pat. No. 4,063,259.

Carry distance and total distance (carry and roll) were determined in a field test using an apparatus commonly referred to in the golf ball industry as a dual pendulum machine. The dual pendulum machine has a pendulum on each side of a motor which swings the pendulums so that they hit two golf balls simultaneously, one with each pendulum. The balls are conditioned at a temperature of 70° F. Two balls at a time are then hit by the pendulums into an open field where carry distance and total distance are individually sighted and recorded by workers. A series of eight balls is hit on each side of the machine. In this case, a series of eight balls of Example 1 were hit on one side of the machine and a series of eight balls of Example 2 were simultaneously hit on the other side. At the of the run, the 16 balls were collected and returned to the machine. They were sorted and then reversed as to the pendulum by which they were hit. Measurements were again made, the balls collected and this procedure was repeated twice more. This gives four hits for each of the eight balls of each of the Examples, a total of 32 hits for the balls of each Example, with 16 being hit by each pendulum. It has been found that this number of hits gives statistically significant results and virtually eliminates wind changes, temperature differences, machine or pendulum differences, etc., especially because balls of the two Examples are hit simultaneously and are alternated as to the pendulum through the series of four tests.

The procedure just described was used for distance testing of both the driver and the #5 iron. The dual pendulum has an adjustable striking face. In order to duplicate a driver, an 11° launch angle was used. An 11° launch angle is achieved by using a striking face having an angle of 13° with respect to the vertical. In order to duplicate a #5 iron, a 21° launch angle was used. A 21° launch angle is achieved by using a striking face having an angle of 26° with respect to the vertical. The results of the spin velocity and driving distance tests are as follows:

COMPARATIVE TESTS

| | Example 1 Balls (Titleist Pro Trajectory) | Example 2 Balls (Present Invention) |
|---|---|---|
| Spin Velocity (rpm) | | |
| 11° | 3135 | 2799 |
| 21° | 5310 | 4788 |
| Carry Distance (yards) | | |
| 11° | 251.3 | 253.7 |
| 21° | 168.8 | 172.3 |
| 11° + 21° | 420.1 | 426.0 |
| Total Distance (Carry + Roll) (yards) | | |
| 11° | 268.5 | 276.3 |
| 21° | 179.1 | 184.7 |
| 11° + 21° | 447.6 | 461.0 |

EXAMPLE 3

Golf balls made according to Example 2 are compared against top grade balata covered golf balls of various manufacturers using the distance tests set forth under the heading "Comparative Tests" following Example 2. There are substantial differences between tests because the tests were carried out under different ambient conditions. The comparative golf balls were current production balls as supplied by the manufacturers to those on the Pro Tour. The results of the tests are as follows:

| | Initial | Carry Distance | | | Total Distance (Carry + Roll) | | |
|---|---|---|---|---|---|---|---|
| | Velocity-USGA | 11° | 21° | 11° + 21° | 11° | 21° | 11° + 21° |
| Wilson T100 | 253.1 | 236.9 | 152.7 | 389.6 | 241.8 | 156.8 | 398.6 |

-continued

| | Initial Velocity-USGA | Carry Distance 11° | 21° | 11° + 21° | Total Distance (Carry + Roll) 11° | 21° | 11° + 21° |
|---|---|---|---|---|---|---|---|
| Golf Ball of Present Invention | 252.7 | 247.6 | 159.6 | 407.2 | 257.8 | 164.8 | 422.6 |
| Golden Ram Pro Tour | 252.8 | 223.0 | 142.5 | 365.5 | 226.1 | 144.2 | 370.3 |
| Golf Ball of Present Invention | 252.9 | 234.7 | 148.8 | 383.5 | 239.8 | 151.0 | 390.8 |
| Hogan Apex 100 | 250.8 | 231.2 | 160.0 | 391.2 | 237.5 | 165.4 | 402.9 |
| Golf Ball of Present Invention | 252.7 | 241.3 | 164.6 | 405.9 | 250.3 | 170.8 | 421.1 |
| MacGregor 100 | 254.0 | 245.9 | 164.5 | 410.4 | 254.1 | 164.5 | 418.6 |
| Golf Ball of Present Invention | 252.8 | 252.6 | 162.3 | 414.9 | 266.1 | 167.5 | 433.6 |

EXAMPLES 4 and 5

These Examples demonstrate that the present invention can also be used with a cover of an ionomer resin, e.g. Surlyn resin from duPont. A series of golf balls were made as in Examples 1 and 2 and designated as Examples 4 and 5. In each case an ionomer resin was substituted for the resin of Examples 1 and 2 as the cover material. The wound ball size was 1.58 inches and the cores for Examples 4 and 5 were made in the same manner and from the same materials. The balls had the same dimple arrangement and dimensions as in Examples 1 and 2. These balls were compared for total distance (carry and roll) in accordance with the procedure previously described and the results were as follows:

| Total Distance (Carry + Roll) (yards) | Example 4 Balls | Example 5 Balls |
|---|---|---|
| 11° | 246.6 | 251.0 |
| 21° | 183.6 | 184.3 |
| 11° + 21° | 430.2 | 435.3 |

EXAMPLES 6 and 7

These Examples demonstrate that the present invention can also be used with a solid core. A series of golf balls were made as in Examples 4 and 5 and designated as Examples 6and 7. In each case a solid core was substituted for the wound core of Examples 4 and 5. The solid core was made according to the teaching of British Patent No. 1,364,138. These balls were compared for total distance (carry and roll) in accordance with the procedure previously described and the results were as follows:

| Total Distance (Carry + Roll) (yards) | Example 6 Balls (Example 4 Balls with Solid Core) | Example 7 Balls (Example 5 Balls with Solid Core) |
|---|---|---|
| 11° | 274.8 | 275.8 |
| 21° | 171.9 | 175.6 |
| 11° + 21° | 446.7 | 451.4 |

EXAMPLE 8

Example 2 is repeated that the balls have 372 dimples rather than 4 dimples. This number of dimples is achieved by eliminating dimples marked 14 on the Figure. Since the Figure shows only those dimples on one hemisphere of the golf ball, the total number of dimples removed is 12, leaving a golf ball with dimples. The dimples have a diameter of 0.155 inches±0.002 inches and a depth of 0.0120 inches±0.0003 inches. The spin rate of the golf balls is the same as that of Example 2 and in distance testing the results are not statistically different from the results of Example 2.

EXAMPLE 9

Example 2 is again repeated except that the balls have 392 dimples rather than 384 dimples. This is accomplished by including dimples 10 in the trademark identification area and the dimples 12 in the numeral identification area on each hemisphere of the golf ball. The spin rate of the golf balls is the same as that of the golf balls of Example 2. In distance testing the results are not statistically different from the results of Example 2.

EXAMPLE 10

Golf balls are made according to Example 2 except that the dimples marked 18 have a diameter of 0.140 inches±0.002 inches while the balance of the dimples have a diameter of 0.160 inches±0.002 inches. The average diameter of all the dimples was 0.151 inches±0.002 inches. The spin rate of the golf balls is the same as that of Example 2. In distance testing the balls of the present Example are statistically superior to the golf balls of Example 2.

It will be understood that the claims are intended to cover all changes and modifications of the preferred embodiments of the invention herein chosen for the purpose of illustration, which do not constitute departures from the spirit and scope of the invention.

What is claimed is:

1. A golf ball having a core and a cover, said golf ball being characterized by:

(a) the materials of said core and said cover being selected so that said golf ball has a spin velocity below 2900 rpm when hit at 230 feet per second by an implement having a face angle of 13° with respect to the vertical;

(b) 384 dimples±3% substantially evenly spaced over the surface of the golf ball, the dimple depth, diameter and number being interrelated according to the following formula:

$$[554.3(d-x)-37(D-y)]^2+[138.6(d-y)+926(d-x)]^2=S$$

wherein:

d=average dimple depth

D=average dimple diameter x=0.275–0.0041667N y=0.2790–0.033N

N=the exact number of dimples divided by 100

$S \geqq 0 \leqq 1$; and (c) the dimples being substantially evenly spaced over the surface of the golf ball except for there being no dimples located immediately adjacent the equator of the ball, which equator corresponds to the parting line of the two hemispherical molds used in forming said cover.

2. The golf ball of claim 1 wherein the core comprises a center covered with elastic thread.

3. The golf ball of claim 14 wherein the resin of the cover is at least 95% transpolyisoprene.

4. The golf ball of claim 3 wherein the resin of the cover is 100% transpolyisoprene.

5. The golf of claim 4 wherein the diameter of the center is at least $1\frac{1}{8}$ inch±0.003 inch.

6. The golf ball of claim 3 wherein the diameter of the center is at least $1\frac{1}{8}$ inch±0.003 inch.

7. The golf ball of claim 1 wherein the resin of the cover comprises an ionomer resin.

8. The golf ball of claim 19 wherein the core is of unitary construction.

9. The golf ball of claim 13 wherein there are 376–392 dimples and the dimples have an average diameter of between 0.145 inch and 0.155 inch and an average depth of between 0.0103 inch and 0.0123 inch.

10. A golf ball having a core and a cover, said golf ball being characterized by:

(a) the materials of said core and said cover being selected so that said golf ball has a spin velocity below 2900 rpm when hit at 230 feet per second by an implement having a face angle of 13° with respect to the vertical;

(b) dimples, the dimples having an average diameter of between 0.145 inch and 0.155 inch and an average depth of between 0.0103 inch and 0.0123 inch;

(c) the dimples being substantially evenly spaced over the surface of the golf ball except for there being no dimples at the equator of the ball.

11. A golf ball having a core and a cover the core being of thread wound construction and being $1\frac{1}{8}$ inch 0.003 inch in diameter and the cover being of at least transpolyisoprene, the said core and the said cover being selected so that said golf ball has a spin velocity below 2900 rpm when hit at 230 feet per second by an implement having a face angle of 13° with respect to the vertical, the golf ball having 392 dimples on the surface thereof, the dimples having an average diameter of between 0.145 inch and 0.155 inch and an average depth of between 0.0103 inch and 0.0123 inch.

12. A golf ball having a core and a cover, said golf ball being characterized by:

(a) the materials of said core and said cover being selected so that said golf ball has a spin velocity below 2900 rpm when hit at 230 feet per second by an implement having a face angle of 13° with respect to the vertical;

(b) 384 dimples±3% substantially evenly spaced over the surface of the golf ball, the dimple depth, diameter and number being interrelated according to the following formula:

$$[554.3(d-x)-37(D-y)]^2+[138.6(D-y)+926(d-x)]^2=S$$

wherein:

d=average dimple depth

D=average dimple diameter x=0.275–0.0041667N y=0.2790–0.033N

N=the exact number of dimples divided by 100

$S \geqq 0 \leqq 1$.

* * * * *

UNITED STATES PATENT AND TRADEMARK OFFICE

CERTIFICATE OF CORRECTION

PATENT NO. : 4,858,923

DATED : August 22, 1989

INVENTOR(S) : William Gobush et al.

It is certified that error appears in the above-identified patent and that said Letters Patent is hereby corrected as shown below:

On the title page:

In the Abstract, add the following at the end thereof:

--The golf ball has 384 dimples ± 3% and the dimples preferably have an average diameter of 0.145-0.155 inches and an average depth of 0.0103-0.0123 inches. The golf ball core can be either thread wound or solid. The cover can be transpolyisoprene or an ionomer. The materials of the core and cover are selected so that the golf ball has a spin velocity below 2900 rpm when hit at 230 feet per second by an implement having a face angle of 13° with respect to the vertical. The dimples are substantially evenly spaced over the surface of the golf ball, and the dimple depth, diameter and number are interrelated according to the following formula:

$$[554.3(d-x) - 37(D-y)]^2 + [138.6(D-y) + 926(d-x)]^2 = S$$

wherein:

$d$ = average dimple depth
$D$ = average dimple diameter
$x = 0.0275 - 0.0041667N$
$y = 0.2790 - 0.033N$
$N$ = the exact number of dimples divided by 100
$S \geq 0 \leq 1$ --;

Column 1, line 9, before "present" insert --The--;

Column 1, line 34, change "was" to --is--;

Column 1, line 43, change "was" to --is--;

UNITED STATES PATENT AND TRADEMARK OFFICE

CERTIFICATE OF CORRECTION

PATENT NO. : 4,858,923

DATED : August 22, 1989

INVENTOR(S) : William Gobush et al.

It is certified that error appears in the above-identified patent and that said Letters Patent is hereby corrected as shown below:

Column 2, lines 3-4, between "use" and "USGA" insert --by the--;

Column 2, line 34, after "of" insert --6%--;

Column 2, line 35, before "tolerance" insert --The--;

Column 2, line 66, change "elating" to --relating--;

Column 4, line 15, change "x = 0.275 - 0.0041667N" to --x = 0.0275 - 0.0041667N--;

Column 4, line 18, change "S $\geqq \leqq$ 1" to --S $\geq$ 0 $\leq$ 1--;

Column 5, line 43, after "1-1/16" insert --inch--;

Column 5, line 59, after the first occurrence of "to" insert --50%--;

Column 6, line 16, change "½" to --1½--;

Column 6, line 20, change "ha" to --have a--;

Column 6, line 29, change "w" to --was--;

Column 6, line 57, after "not" insert --have--;

Column 7, line 40, after "Each" insert --ball--;

Column 7, line 42, change "The" to --These--;

UNITED STATES PATENT AND TRADEMARK OFFICE

CERTIFICATE OF CORRECTION

PATENT NO. : 4,858,923

DATED : August 22, 1989

INVENTOR(S) : William Gobush et al.

It is certified that error appears in the above-identified patent and that said Letters Patent is hereby corrected as shown below:

Column 7, line 47, change "bal" to --ball--;

Column 9, line 48, change "6and" to --6 and--;

Column 9, line 66, after "repeated" insert --except--;

Column 9, line 67, change "4" to --384--;

Column 9, line 68 - Column 10, line 21, change "the Figure" to --Fig. 1-- in both instances--;

Column 10, line 23, after "with" insert --372--;

Column 10, line 68, change "d-y" to --D-y--;

Column 11, line 5, change "x = 0.275 - 0.0041667N" to --x = 0.0275 - 0.0041667N--;

Column 11, line 19, change "claim 14" to --claim 2--;

Column 11, line 30, change "claim 19" to --claim 7--;

Column 11, line 32, change "claim 13" to --claim 1--;

Column 12, line 3, before the first occurrence of "dimples" insert --376-392--;

Column 12, line 9, after "cover" insert --,--;

UNITED STATES PATENT AND TRADEMARK OFFICE

CERTIFICATE OF CORRECTION

PATENT NO. : 4,858,923

DATED : August 22, 1989

INVENTOR(S) : William Gobush et al.

It is certified that error appears in the above-identified patent and that said Letters Patent is hereby corrected as shown below:

Column 12, line 11, before "0.003" insert --±--;

Column 12, line 12, before "transpolyisoprene" insert --95%--;

Column 12, line 37, change "x = 0.275 - 0.0041667N" to --x = 0.0275 - 0.0041667N--.

Signed and Sealed this

Nineteenth Day of May, 1992

*Attest:*

DOUGLAS B. COMER

*Attesting Officer*

*Acting Commissioner of Patents and Trademarks*